US008636325B2

(12) United States Patent
Greenspan et al.

(10) Patent No.: US 8,636,325 B2
(45) Date of Patent: Jan. 28, 2014

(54) MINING AND DEMOLITION TOOL

(76) Inventors: Gregory Greenspan, Solon, OH (US); Alexander Greenspan, Solon, OH (US); Gene Alter, Chagrin Falls, OH (US)

( * ) Notice: Subject to any disclaimer, the term of this patent is extended or adjusted under 35 U.S.C. 154(b) by 0 days.

(21) Appl. No.: 13/473,131

(22) Filed: May 16, 2012

(65) Prior Publication Data

US 2013/0002004 A1 Jan. 3, 2013

Related U.S. Application Data

(63) Continuation-in-part of application No. 13/181,693, filed on Jul. 13, 2011, now Pat. No. 8,197,011, which is a continuation of application No. 12/317,036, filed on Dec. 18, 2008, now Pat. No. 8,020,940, which is a continuation-in-part of application No. 12/290,982, filed on Nov. 5, 2008, now Pat. No. 7,963,615.

(51) Int. Cl.
*E21C 35/183* (2006.01)

(52) U.S. Cl.
USPC ..... 299/105; 299/101; 299/111; 299/113

(58) Field of Classification Search
USPC ..... 299/79.1, 87.1, 101, 102, 103, 105, 299/106, 107, 110, 111, 113
See application file for complete search history.

(56) References Cited

U.S. PATENT DOCUMENTS 2,528,300 A 10/1950 Degner
3,331,637 A 7/1967 Krekeler
3,361,481 A 1/1968 Maddock
3,718,370 A * 2/1973 Caserta ..... 299/113
3,833,264 A 9/1974 Elders
3,833,265 A 9/1974 Elders
3,992,061 A * 11/1976 Rollins ..... 299/102
4,194,791 A 3/1980 Montgomery, Jr. et al.
4,251,109 A 2/1981 Roepke
4,371,210 A 2/1983 Leibee
4,480,873 A 11/1984 Latham
4,697,850 A 10/1987 Tuneblom
4,911,503 A 3/1990 Stiffler et al.
5,052,757 A 10/1991 Latham
5,141,289 A 8/1992 Stiffler
5,219,209 A * 6/1993 Prizzi et al. ..... 299/111
5,551,760 A 9/1996 Sollami
5,842,747 A 12/1998 Winchester
5,873,423 A 2/1999 Briese
6,019,434 A 2/2000 Emmerich
6,224,163 B1 5/2001 Nies et al.
6,354,771 B1 3/2002 Bauschulte et al.
RE38,151 E * 6/2003 Penkunas et al. ..... 299/111
6,779,850 B1 8/2004 Schibeci et al.

(Continued)

*Primary Examiner* — Frederick L Lagman
(74) *Attorney, Agent, or Firm* — McDonald Hopkins LLC

(57) ABSTRACT

Apparatus, methods, and other embodiments associated with a mining and demolition tool are described herein. In an embodiment, a mining bit tool includes a mining and demolition bit tool base and a mining bit tool tip coupled to the mining bit tool base. The base includes a tapered portion and a stem. The tapered portion includes a first end and a second end, with a surface tapering from the first end to the second end. There are at least two flutes positioned along the tapered surface, where a first flute is positioned at an angle relative to a longitudinal axis passing through the center of the mining bit tool and a second flute is positioned to cross a path of the first flute. The stem extends from the first end of the tapered portion, and the tip is coupled to the second end of the tapered portion.

7 Claims, 14 Drawing Sheets

(56) References Cited

U.S. PATENT DOCUMENTS

| | | | | |
|---|---|---|---|---|
| 6,938,961 | B2 * | 9/2005 | Broom | 299/100 |
| 6,986,552 | B1 | 1/2006 | Sollami | |
| 7,338,134 | B2 | 3/2008 | Latham | |
| 7,380,887 | B2 | 6/2008 | Latham | |
| 7,445,294 | B2 | 11/2008 | Hall et al. | |
| 7,963,615 | B2 | 6/2011 | Greenspan et al. | |
| 8,020,940 | B2 | 9/2011 | Greenspan et al. | |
| 8,197,011 | B2 | 6/2012 | Greenspan et al. | |
| 2002/0062996 | A1 * | 5/2002 | Dvorachek | 299/111 |
| 2003/0141753 | A1 * | 7/2003 | Peay et al. | 299/111 |
| 2003/0209366 | A1 | 11/2003 | McAlvain | |
| 2003/0230926 | A1 | 12/2003 | Mondy et al. | |
| 2004/0026983 | A1 | 2/2004 | McAlvain | |
| 2007/0114835 | A1 | 5/2007 | Latham | |
| 2008/0084106 | A1 | 4/2008 | Marathe et al. | |

* cited by examiner

MINING AND DEMOLITION TOOL

CROSS-REFERENCE TO RELATED APPLICATION

This application is a continuation in part of U.S. patent application Ser. No. 13/181,693 filed on Jul. 13, 2008 now U.S. Pat. No. 8,197,011 and titled MINING AND DEMOLITION TOOL, which is a continuation of U.S. patent application Ser. No. 12/317,036 filed on Dec. 18, 2008 now U.S. Pat. No. 8,020,940 and titled MINING AND DEMOLITION TOOL, which is a continuation-in-part of U.S. patent application Ser. No. 12/290,982 to Greenspan et al. filed on Nov. 5, 2008 now U.S. Pat. No. 7,963,615, and titled MINING AND DEMOLITION TOOL, each of which are hereby incorporated in their entirety by reference.

FIELD OF INVENTION

The present invention generally relates to a mining and demolition tool for rotating drums and, more particularly, to a mining and demolition tool arranged to rotate about its longitudinal axis during mining operations to increase durability and extend service life, thus, substantially increasing productivity and reducing wear and tear on a mining machine.

BACKGROUND

The mining industry has developed various machines and systems for mining pockets of coal and minerals or seams of other such valuable and precious materials deposited in the subsurface. Such valuable subsurface seams of material are often located deep underground and cannot be economically accessed from the surface. Deep mining techniques have been developed to access such underground pockets of material. Deep mining techniques often include machinery that forms a mineshaft while extracting material from the seam. In one technique, the machinery burrows or tunnels into a wall of a mineshaft and removes nearly all the material along the seam leaving only natural or man-made pillars to support the roof of the mine.

One technique of deep or subsurface mining is longwall or conventional mining. Such mining techniques typically include remote-controlled equipment such as rotating machines that break-up and loosen desired materials from a wall to form and deepen the mineshaft. In addition, large hydraulic mobile roof-supporting equipment is used to stabilize the mineshaft and allow further mining of the desired materials. Mining machinery may span 30 feet or more and include rotating drums that move laterally along a seam to mine the desired materials. A typical drum may be for example eight feet in diameter and twenty feet wide and include dozens if not hundreds of mining tools such as bits or teeth to engage and scrape the mineshaft wall to loosen the desired materials. The loosened material typically falls down onto a conveyor belt for removal from the mineshaft. Another deep mining technique—continuous mining—also uses machines with large rotating drums equipped with mining tools to scrape or loosen the desired material from the seam.

The mining tools secured to the rotating drum in a longwall or continuous mining operation often chip, break, wear or otherwise fail after a relatively short service life. This is often due to the tools engaging with hardened pockets of rock or minerals embedded in a seam. Tools that fail relatively quickly or prematurely reduce the efficiency of mining operations and eventually require that the mining operation temporarily cease so that failed tools may be swapped out for new or reconditioned tools. Tools are typically swapped out manually in a time consuming and costly maintenance process.

Because of the inefficiencies of current mining apparatus and methods, there is a need in the mining industry for novel apparatus and methods for extending the service life of mining tools to increase the efficiency of mining operations.

SUMMARY OF INVENTION

Apparatus, methods, and other embodiments associated with a mining and demolition tool are described herein. In an embodiment, a mining bit tool includes a mining and demolition bit tool base and a mining bit tool tip coupled to the mining bit tool base. The base includes a tapered portion and a stem. The tapered portion includes a first end and a second end, with a surface tapering from the first end to the second end. There are at least two flutes positioned along the tapered surface, where a first flute is positioned at an angle relative to a longitudinal axis passing through the center of the mining bit tool, and a second flute is positioned to cross a path of the first flute. The stem extends from the first end of the tapered portion, and the tip is coupled to the second end of the tapered portion.

DESCRIPTION OF DRAWINGS

Operation of the invention may be better understood by reference to the following detailed description taken in connection with the following illustrations, wherein.

DETAILED DESCRIPTION OF INVENTION

Figure 1:
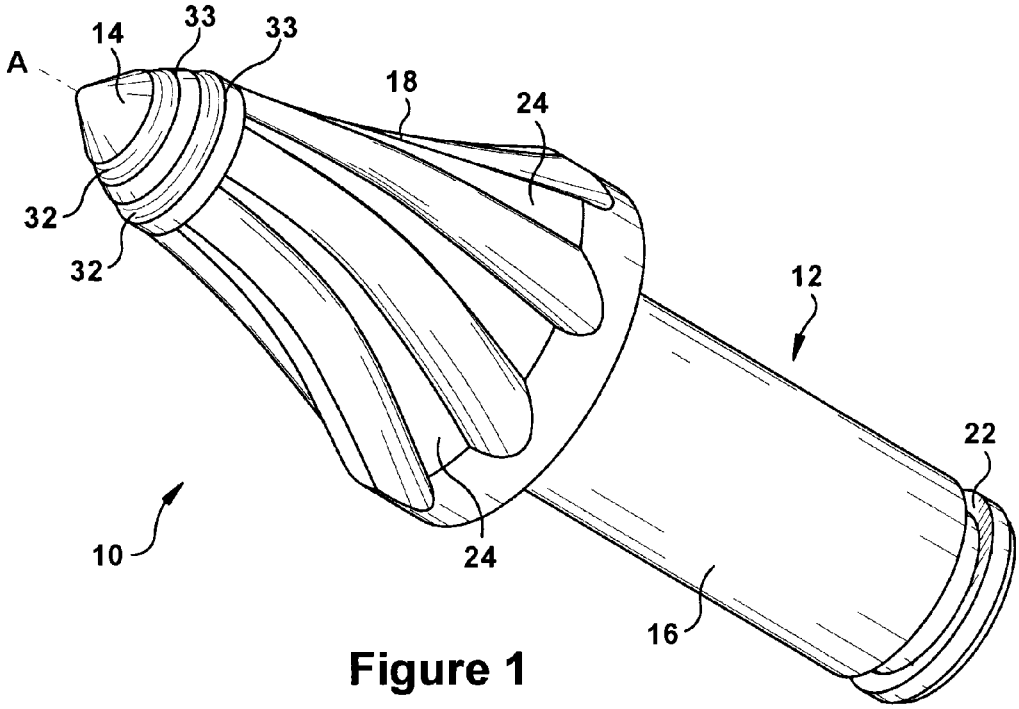
FIG. 1 is a perspective view of a mining bit tool.

While the present invention is described with reference to the embodiments described herein, it should be clear that the present invention should not be limited to such embodiments. Therefore, the description of the embodiments herein is illustrative of the present invention and should not limit the scope of the invention as claimed.

In one embodiment of a mining bit tool disclosed herein, the mining bit tool is designed to be secured to a rotating drum. In an embodiment, the mining bit tool is secured to the rotating drum with a bit tool holder. Furthermore, the drum may be designed such that dozens or even hundreds of mining bit tools are secured to the drum through multiple bit tool holders. The drum is arranged to mine desired materials in underground mines. The drum may be rotated so that the mining bit tools scrape, dig into, or otherwise engage a wall of the mineshaft to loosen material from the wall. The mining bit tools may be arranged so that the tools rotate about a longitudinal axis then engaging the wall. Such rotation exposes multiple portions of the peripheral surface of the mining bit tools to the rigors of engagement with the wall and may result in a longer service life for the mining bit tools.

It will be understood that while the detailed description and figures herein describe and illustrate mining and demolition tools as mining bit tools, the present invention contemplates other types of mining and demolition tools as well. Embodiments of mining and demolition tools are contemplated by the present invention provided a mining and demolition tool is arranged to rotate or otherwise move due to engagement with a wall of a mine so that multiple portions of the peripheral surface of the mining bit tools are exposed to engagement with the mining wall. In addition, although embodiments are referred to as mining bit tools, it will be understood by those skilled in the art that tools described and illustrated herein are arranged to be capable of mining as well as demolition.

In another embodiment, a mining bit tool includes two components—a mining bit tool base and a mining bit tool tip. The mining bit tool tip is secured to the mining bit tool base to form the mining bit tool. In one embodiment, a brazing process may be used to secure the mining bit tool tip to the mining bit tool base. The mining bit tool tip is positioned so that the tip absorbs a substantial portion of the engagement with the wall of the mineshaft. The tip may include multiple cutting surfaces for removing material from the mineshaft wall. The tip may be secured by brazing to the base such that a portion of the tip extends over the base to at least partially shield an end of the base from engagement with the wall. The tip may be constructed from a durable material, such as tungsten carbide for example. The tip material may be more durable than a material used to construct the base with regard to wear and tear due to engagement with a mineshaft wall. Such an arrangement minimizes wear on the base and may result in a longer service life for the mining bit tool.

Figure 2:
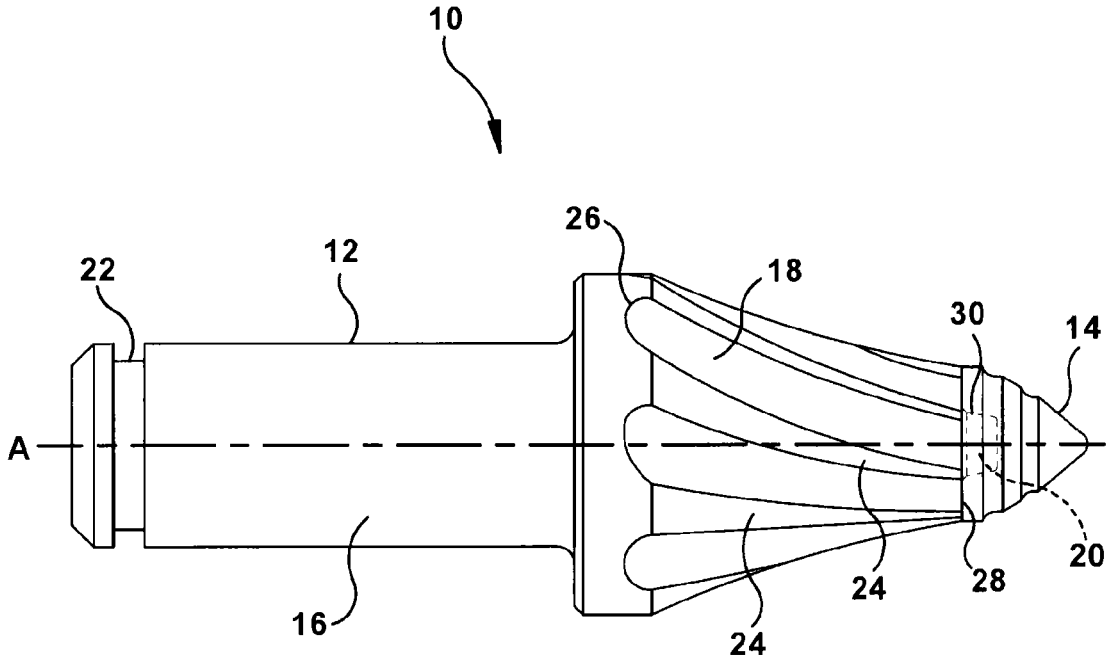
FIG. 2 is a side view of a mining bit tool.

An exemplary embodiment of a mining bit tool 10 is illustrated in FIGS. 1 and 2. The mining bit tool 10 includes a mining bit tool base 12 and a mining bit tool tip 14. As will be further detailed, the base 12 may include a sidewall with spiral features. The tip 14 is secured, attached, or otherwise coupled to the base 12 to form the mining bit tool 10. In one embodiment, the tip 14 is secured to the base 12 through a brazing process. A brazing process may include the steps of forming the tip 14 and base 12 so that the components form a close or tight fit when the tip 14 and base 12 are assembled to form the mining bit tool 10; placing a flux material on the engagement surfaces of the tip 14 or the base 12; heating or melting filler metal or an alloy; and distributed the molten material between the interface of the tip 14 and base 12 by capillary action. The molten filler metal and flux interact with a layer of the material of the tip 14 and a layer of the material of the base 12. When the mining bit tool 10 is cooled, a strong sealing joint is formed between the tip 14 and base 12. The brazed joint is formed by the metallurgical linking of layers of the tip 14 and base 12.

Figure 4:
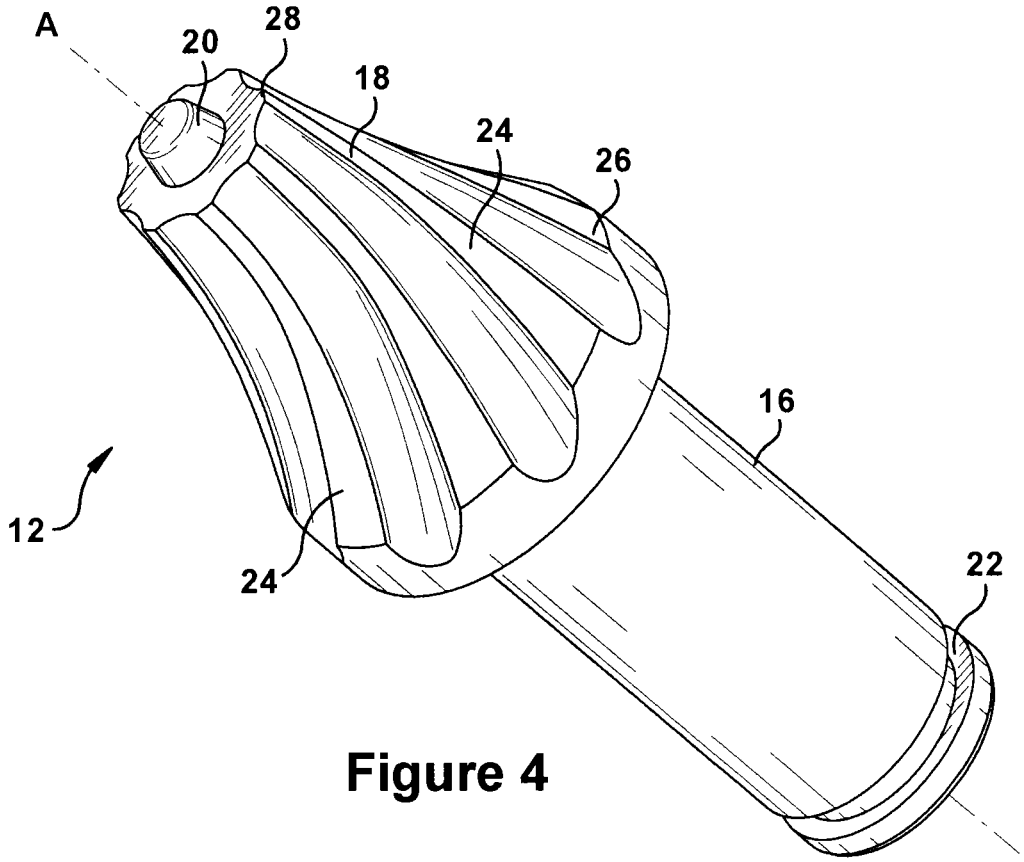
FIG. 4 is a perspective view of a mining bit tool base.
Figure 5:
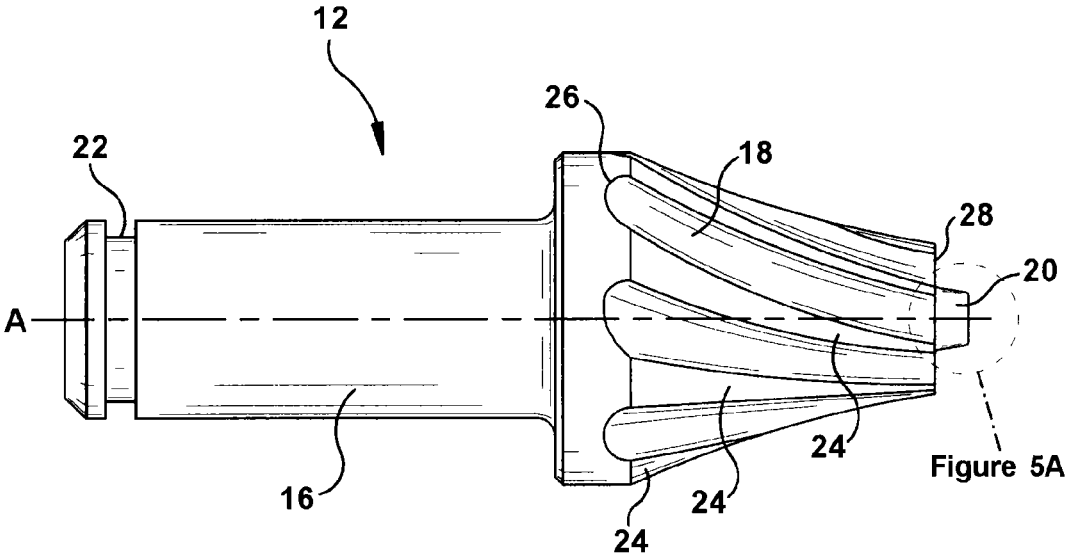
FIG. 5 is a side view of a mining bit tool base.
Figure 5A:
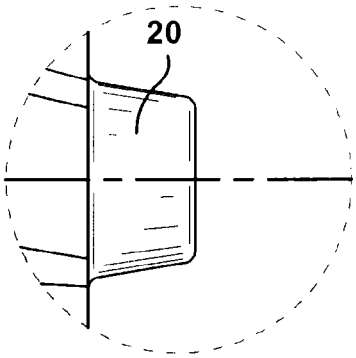
FIG. 5A is a side view of detail 5A of FIG. 5.

As seen in FIGS. 4 and 5, the mining bit tool base 12 includes an elongated stem 16, a tapered portion 18, and a post 20 extending from the tapered portion 18. The stem 16 includes a recessed annular groove 22. As will be further explained below, the annular groove 22 is arranged to facilitate the securing of the mining bit tool 10 to a rotating drum. The tapered portion 18 is generally shaped as a truncated cone and includes a plurality of flutes or ridges 24 running generally along the surface of the tapered portion 18 of the base 12. As best seen in FIG. 5A, the post 20 is generally cylindrically shaped with a slight taper along the cylindrical surface. The mining bit tool base 12 may be fabricated, manufactured, or otherwise formed from hardened steel. In an embodiment, once the base 12 is formed it may have a hardness of 43-50 on the Rockwell scale. The materials used to form the base 12 may be selected for the ability of the material to withstand relatively large impact forces while maintaining the integrity of the shape of the base 12. For example, forming the base 12 from hardened steel may provide the base 12 with the ability to absorb and withstand cantilever or bending forces placed in the tool 10. It will be understood that when the tool 10 engages the wall of a mineshaft, the base 12, and specifically the stem 16, may absorb a substantial portion of the bending forces applied to the tool 10. Hardened steel or other similar materials may be successful in absorbing such bending forces without fracturing, plastically deforming, or otherwise failing, thus, extending the service life of the tool 10.

Figure 3:
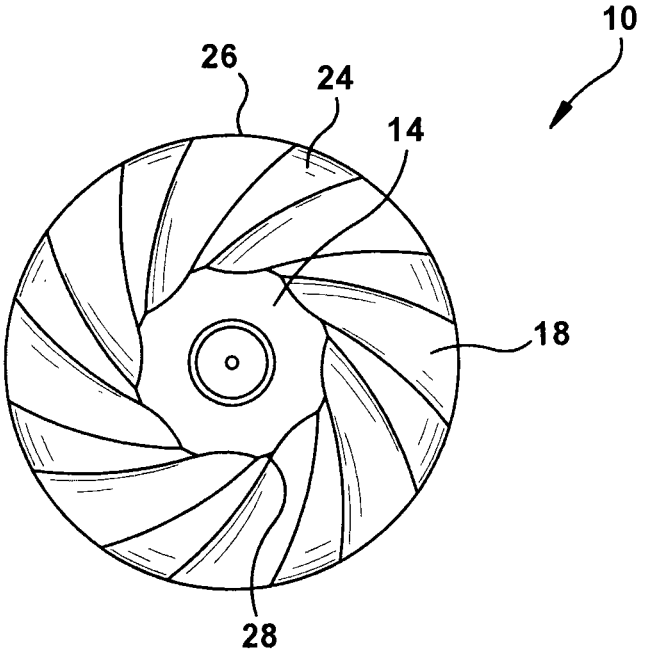
FIG. 3 is a top view of a mining bit tool.

As may be best seen in FIGS. 4 and 5, the flutes 24 follow a generally helical or spiral path along the surface of the tapered portion 18. In one embodiment of the mining bit tool 10, the flutes 24 follow a spiral path that is generally arranged at a 45 degree angle to a longitudinal axis A passing through the center of the mining bit tool 10. In such an embodiment, there are eight flutes 24 (as best seen in FIG. 3) running along the surface of the tapered portion 18 of the base 12. Each flute 24 may generally run from a first end 26 of the tapered surface 18 to a second end 28 of the tapered surface 18. Although it will be readily understood by those of ordinary skill in the art that a flute may not run the full length of the tapered surface. For example, a flute may begin and end just short of the ends of the tapered surface, a flute may only run from one end of the tapered surface to near a midpoint if the tapered surface, etc. In addition, although the flutes 24 are shown as following a generally spiral path, a flute may be arranged in any number of patterns. For example, a flute may be positioned diagonally along the tapered surface, or a flute may be positioned so that at least a portion is positioned at an angle relative to the longitudinal axis A passing through the center of the mining bit tool 10.

In other exemplary embodiments of the mining bit tool, there may be four or six or any practicable number of flutes running along the tapered surface of a mining bit tool. Such arrangements of multiple flutes running along the tapered surface may include groups of flutes arranged in different patterns. For example, a first group of flutes may be arranged in a pattern that spirals along the surface in a first direction and a second group of flutes may be arranged in a pattern that spirals along the surface in a second direction. Such an arrangement may form a network of crisscrossing or interwoven flutes running along the tapered surface.

The flutes 24 may assist or facilitate the removal of material from the wall of a mineshaft by offering cutting edges that may assist in loosening or scraping away material from a seam. The depth and width of the flute 24, its spiral or angled positioning, and the tapered nature of the base 12 may all assist in providing cutting edges. As may be seen in FIGS. 1 through 5, the shape of the flutes 24 may change as it runs along the tapered surface 18 of the base 12. In one example, the thickness and depth of the flute 24 may both increase as the flute 24 runs from the second end 28 of the tapered surface 18 to the first end 26 of the tapered surface 18. In addition, the flute 24 may be arranged so that it has a generally flat surface (i.e. generally parallel to the face of the tapered surface 18) that is bounded by two sidewalls running generally from the flat surface to the tapered surface 18. The intersections of the flat surface and the sidewalls form generally right angles, which may provide effective cutting edges for loosening or removing material from the mineshaft wall.

Figure 6:
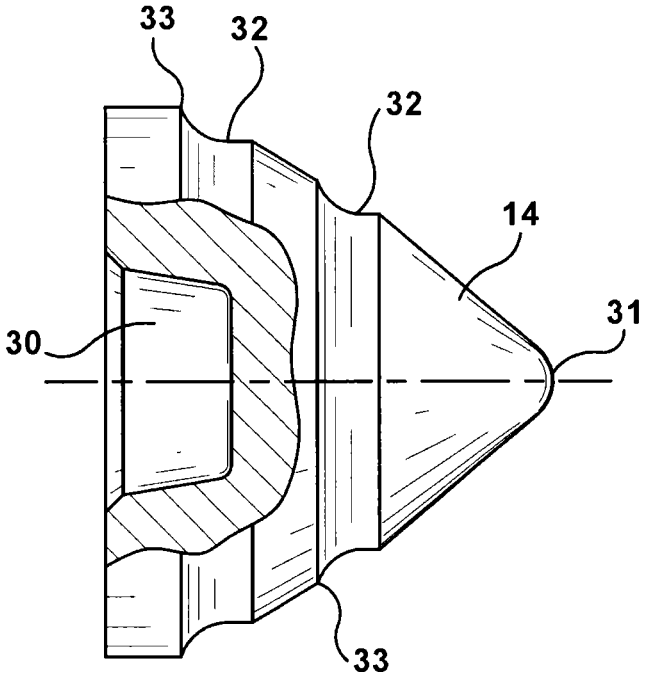
FIG. 6 is a partial cross-sectional side view of a mining bit tool tip.

As may be best seen in FIG. 6, the mining bit tool tip 14 is cone shaped and includes an internal cavity 30 and a pair of annular grooves 32 along the outer surface of the tip 14. The tip 14 may be fabricated, manufactured, or otherwise formed as a carbide tip. For example, a carbide tip 14 may be formed from tungsten carbide and titanium carbide. Such a tip 14 may increase durability and extend the service life of the mining bit tool 10. The tough and abrasive properties of carbide materials make a carbide tip 14 successful in withstanding the sudden impact and frictional forces experienced by mining and demolition tools upon engagement with the mineshaft wall. The carbide tip 14 may fracture material from the wall, form a groove or passage by wedging into the wall, or scrape fragments of material from the wall through impact and friction. In addition, the forming of passages or grooves in the wall by the tip 14 may form an initial pathway in the wall for the mining bit tool body 12 to follow. Cutting edges of the flutes 24 may be more effective at removing material from the wall when following the tip 14 into a groove in the mineshaft wall. In addition, because of the tapered nature of the body 12, once the tapered portion 18 enters into or wedges into the pathway, lateral forces exerted on the wall by the tapered portion 18 may break off large pieces of the wall, thus, resulting in effective mining. Although the mining bit tool tip 14 is described as cone shaped, it will be understood that a mining bit tool tip may be configured in other geometric arrangements. For example, a tip may be arranged generally as a cone, but with a convex or bulging tapered surface; a tip may be arranged as a truncated cone; a tip may be arranged as a polyhedron shape such as a pyramid, or the like. The tip may be arranged in any shape that provides for impacting the wall to fracture the wall or form a pathway for the remainder of the tool to follow so that the flutes engage with the wall and generally cause the tool to rotate during the mining process.

The mining bit tool tip 14 may be arranged to have multiple features that facilitate the removal of material from a mineshaft wall. In an embodiment, such as that illustrated in FIG. 6, a tip 14 may include three distinct cutting or fracture features. The head 31 of the tip 10 (i.e., the peak of the cone shape of the tip 14) may serve as a point of impact or contact with a mineshaft wall by which the tool 10 fractures or loosens material. The head 31 may be arranged to absorb the direct impact with the wall to form a fracture in the wall. As the drum continues to rotate, the tip 14 may continue to penetrate into the wall and wedge into the fracture or otherwise form a channel in the wall surface through which the remaining portions of the tool 10 follow. The tip 14 may form the channel by cutting into the wall, grinding the wall, and the like. As previously described, once the tip 14 forms a channel in the wall, the tapered nature of the tool 10 wedges into the channel, rotates due to engagement between the flutes 24 and the wall, and may break away large portions of the wall.

The annular grooves 32 may also be arranged to include cutting features. Each groove 32 includes a cutting edge 33 at the lower portion of the groove 32 (i.e., at the portion of the groove 32 with the largest diameter). Such cutting edges 33 follow the head 31 into the channel formed as the tip 14 fractures the wall to further cut, scrape, dig into, or otherwise remove material from the wall. The grooves 32 may serve as a path through which fragments of the wall may be deflected during cutting. The cutting edges 33 may contribute to the removal of large portions of the wall as the cutting edges 33 cut and dig into the wall. It will be understood by those skilled in the art that more than or less than three cutting or fracture features may be included in a mining bit tool tip.

The post 20 extends from the second end 28 of the tapered portion 18 of the base 12. As may be seen in FIG. 6, the internal cavity 30 of the tip 14 is arranged to facilitate the joining of the tip 14 and base 12 to form the mining bit tool 10. The post 20 includes a slight taper as it extends from the tapered portion 18 of the base 12, and the internal cavity 30 of the tip 14 is tapered and generally cylindrical to match the size and shape of the post 20. The dimensions of the post 20 and cavity 30 are designed to form a close or a tight fit when the post 20 is positioned within the cavity 30.

In one embodiment, the tip 14 is secured or coupled to the base 12 by a brazing process. In such a process flux material is placed on the inner surface of the cavity 30 and on the outer surface of the post 20. It will be understood that in other embodiments, flux may be place on only the inner surface of the cavity 30 or on only the outer surface of the post 20. Once the flux is positioned, the tip 14 is placed onto the base 12 by inserting the post 20 into the cavity 30. A filler material such as an alloy is placed at the interface of the tip 14 and base 12. The filler material is heated to above the melting point of the filler material so that the filler material becomes molten. In one embodiment, the filler material is heated to above 450 degrees Celsius to melt the material. Once the filler material is molten, capillary action causes the filler material to migrate into the joint between the post 20 and the cavity 30. It will be understood by those skilled in the art that the filler material and flux react with the outer surface of the post 20 and the inner surface of the cavity 30 to form a strong bond between the tip 14 and the base 12, which results in a strong and durable mining bit tool 10. It will be understood that processes other than brazing may be utilized to secure the tip 14 to the base 12. For example, the tip 14 may be secured to the base 12 by welding, chemical bonding, mechanical bonding, and the like. In addition, a mining bit tool may be fabricated with a tip integrally formed with a base.

Figure 7:
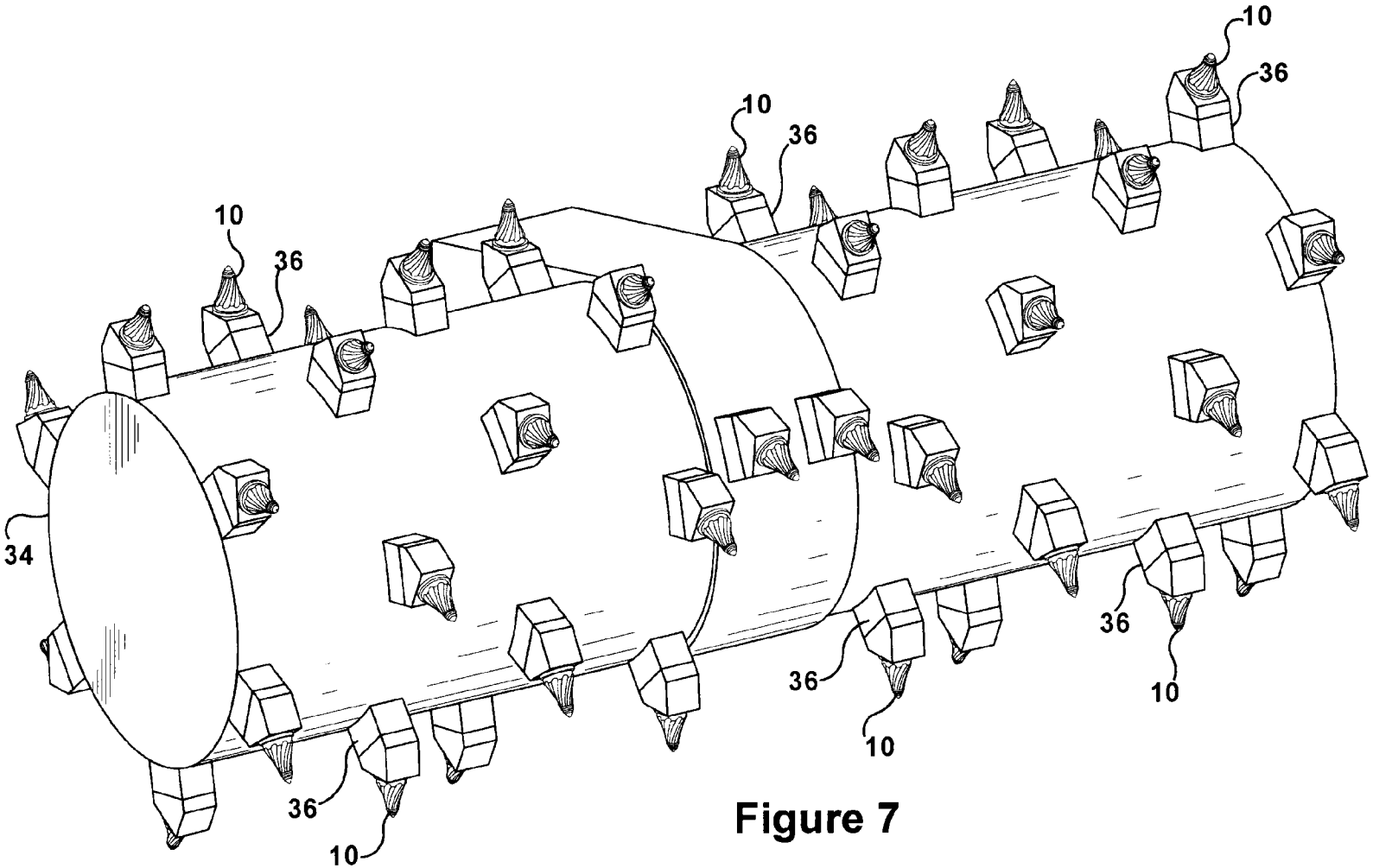
FIG. 7 is a schematic perspective view of a rotating drum with a plurality of mining bit tools secured to the drum.
Figure 8:
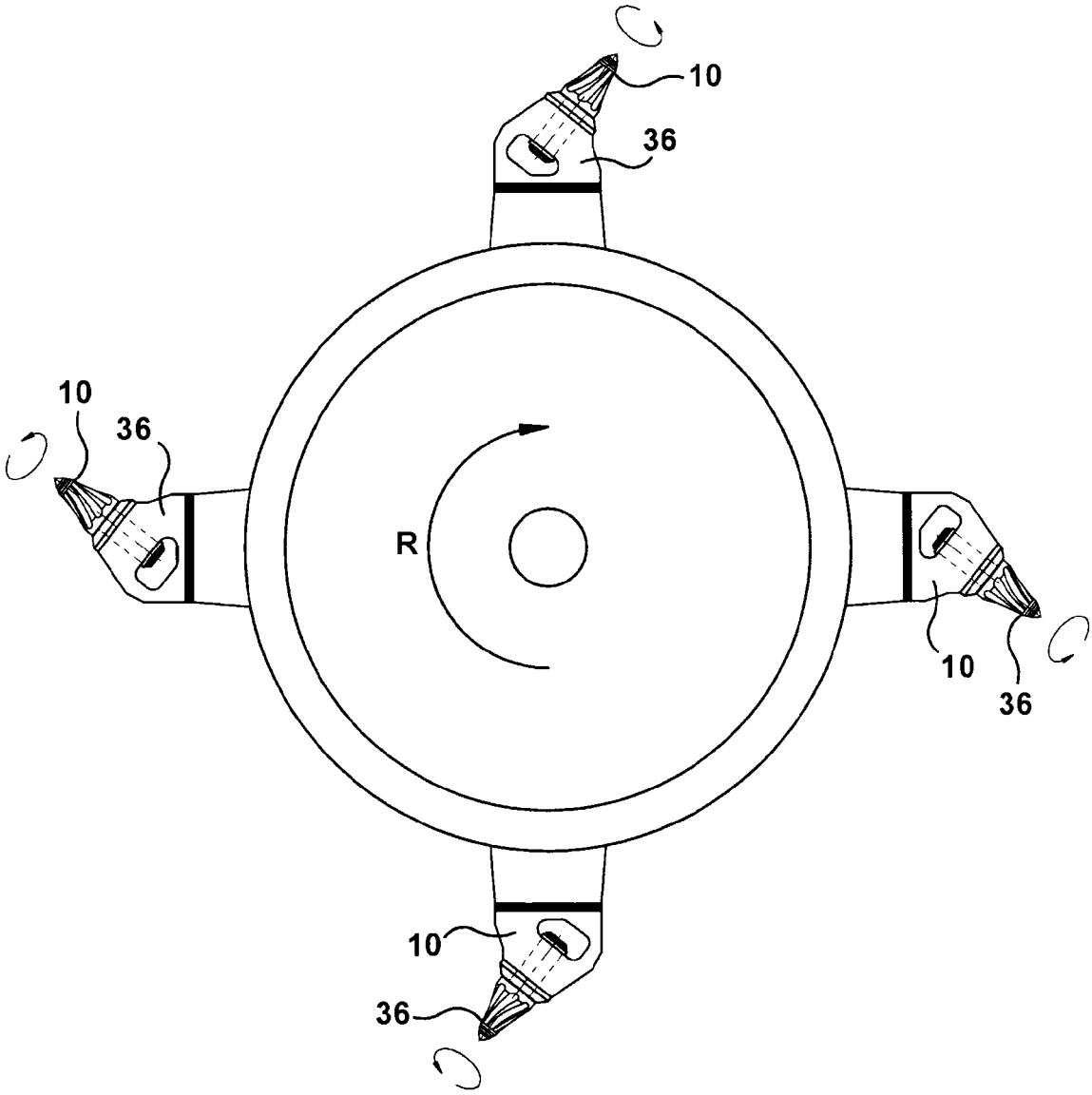
FIG. 8 is a schematic side view of a rotating drum with a plurality of mining bit tools secured to the drum.

Once mining bit tools 10 are formed, a plurality of mining bit tools 10 may be secured to a rotating drum 34 for use in mining operations. As seen in FIGS. 7 and 8, a plurality of mining bit tools 10 may be secured in a plurality of tool holders 36 secured onto the surface of a drum 34. In one embodiment, the holders 36 are secured to the drum 34 by a welding process. The drum 34 may rotate in the direction of the arrow R shown in FIG. 8 so that the mining bit tools 10 scrape against or otherwise engage the wall of a mineshaft to loosen material from the wall.

Figure 9:
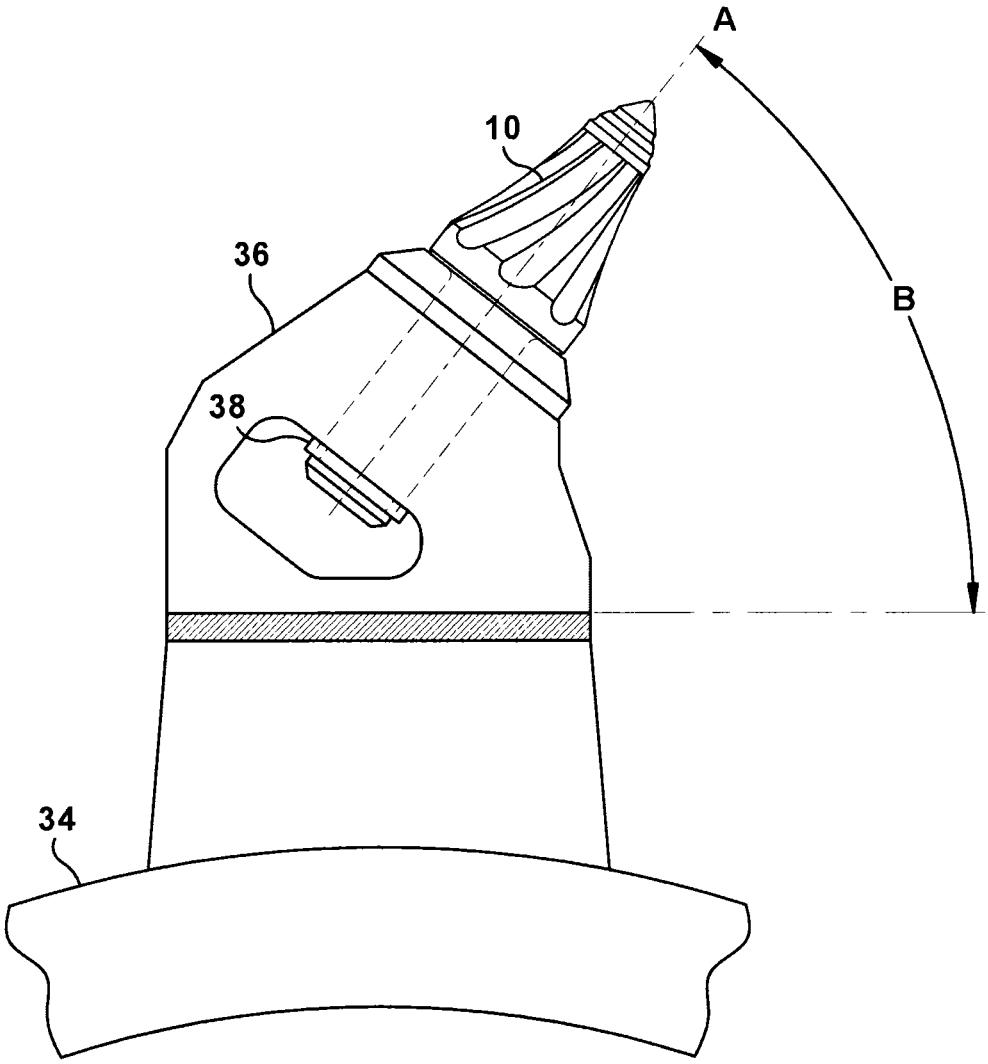
FIG. 9 is a schematic side view of a mining bit tool secured to a rotating drum.

As seen in FIG. 9, the mining bit tools 10 may be secured to or retained by the holders 36 with a clip or ring 38 positioned in the annular groove 22 of the stem 16. The clip 38 may be arranged so that it may be manually removable to release the mining bit tool 10 from the holder 36. The mining bit tools 10 may be arranged to extend tangentially from the surface of the drum 34. In one embodiment, the mining bit tools 10 extend generally at an angle B from the surface of the drum 34. For example, in one embodiment the mining tool 10 may extend at an angle 45 degrees from the surface of the drum 34. In another embodiment, the mining tool 10 may extend anywhere from 35 degrees to 55 degrees from the surface of the drum 34. Such positioning may depend on a number of factors such as the diameter of a drum, the type of material being mined, the speed of the rotation of the drum, and the like.

The flutes 24 may be arranged to facilitate longer service life for a mining bit tool 10. Typically a mining bit tool secured to a rotating drum is statically positioned with respect to the drum. This is to say that the same portion of the mining bit tool repeatedly engages the wall of the mineshaft in an attempt to loosed material. In such an arrangement, a localized portion of the mining bit tool absorbs the majority if not all the wear and tear and other damage, which leads to relatively rapid failure of the tool. In the embodiments disclosed herein, the helical or spiral shape of the flutes 24 facilitates rotation of the mining bit tool 10 due to impact and frictional forces each time the mining bit tool 10 engages the wall of the mineshaft. Because of the angled nature of the spiral shape, a portion of the energy absorbed by a flute 24 as it contacts the mining wall translates into a tangential or lateral force on the bit tool 10, which results in a slight indexing rotation of the bit tool 10 about its longitudinal axis A with each engagement with the mining wall. Such rotation subjects the mining bit tool 10 to even wear and tear and other damage along its entire outside surface because the rotation continuously exposes a different portion of the mining bit tool 10 to engagement with the wall of the mineshaft. It will be understood by one skilled in the art that such rotation may decrease the wear and tear on the head 31 of the tip 14, cutting edges 33 of the grooves 32, and cutting edges of the flutes 24.

In one embodiment, the mining bit tool 10 is arranged so that the arrangement of the mining bit tool tip 14 and flutes 24 facilitates the rotation of the tool 10 during operation. As previously described herein, the tip 14 is arranged to fracture a mineshaft wall and form a channel for the remainder of the tool 10 to follow as it rotates on the drum 34. Because the flutes 24 have a larger diameter than the tip 14 and are positioned just below the tip 14, the flutes 24 contact the wall nearly immediately after the initial impact of the tool 10 on the wall. Such contact causes the tool 10 to rotate while the tip 14 and flutes 24 are in contact with the wall and fracturing or cutting the wall. Such an arrangement facilitates the cutting and fracturing operation, insures rotation of the tool 10 to increase service life of the tool 10, and utilizes all cutting surfaces and features in removing material from the wall.

In addition, to facilitation the removal of material, such arrangements also generally reduce the stress and wear and tear on the machinery. Because the mining bit tool 10 rotates during impact and cutting, a portion of the impact and cutting forces are dissipated by the rotation of the tool 10. Therefore, less force is absorbed by the stem 16 of the tool 10 or by the tool holders 36. Such arrangements, therefore, also may further increase the service life of the tools 10 and the tool holders 36. The dissipation of impact force through rotation of the tool 10 also reduces the force needed to rotate the drum 34. Such a reduction in the force needed to rotate the drum reduces wear and tear on the structural components of the drum 34 along with the motor used to rotate the drum. It will be appreciated by those of ordinary skill in the art, that such reduction of wear and tear may lead to longer service life for both the drum and the motor rotating the drum.

It will be readily understood by those skilled in the art that rotation of the bit tool 10 during operation promotes even wear along the bit tool 10 and may lead to a substantially longer service life than an arrangement that repeatedly localizes the wear and damage to a portion of a mining bit tool. It will be understood that flutes may be positioned at different angles and in different configurations to result in different amounts of rotation due to impact and frictional forces from the wall of a mineshaft. Depending on the specific implementation of a mining bit tool, a lesser or greater about of indexed rotation may be desired.

In one embodiment, a tip of the mining bit tool is sized so that a portion for the tip extends over a portion of the tapered portion of the base. In such an arrangement, a carbide tip may further protect a hardened steel base against wear and damage. The extended portion of the tip absorbs more of the contact and impact from the wall of the mineshaft thus, extending the service life of the mining bit tool. In addition, in such an embodiment the joint securing the mining bit tool tip to the mining bit tool base is larger and forms a strong bond between the tip and base. Filler material used in the brazing process flows underneath the tip and into the engagement joint between the tip and base. The engagement joint is larger because of the tip overlays a portion of the tapered surface of the base; therefore, the bonding layer formed by the filler material is larger. Such an arrangement allows for a larger bonding area to absorb and transfer the impact of the tool on the mining wall to the rugged mining bit tool base.

Figure 10:
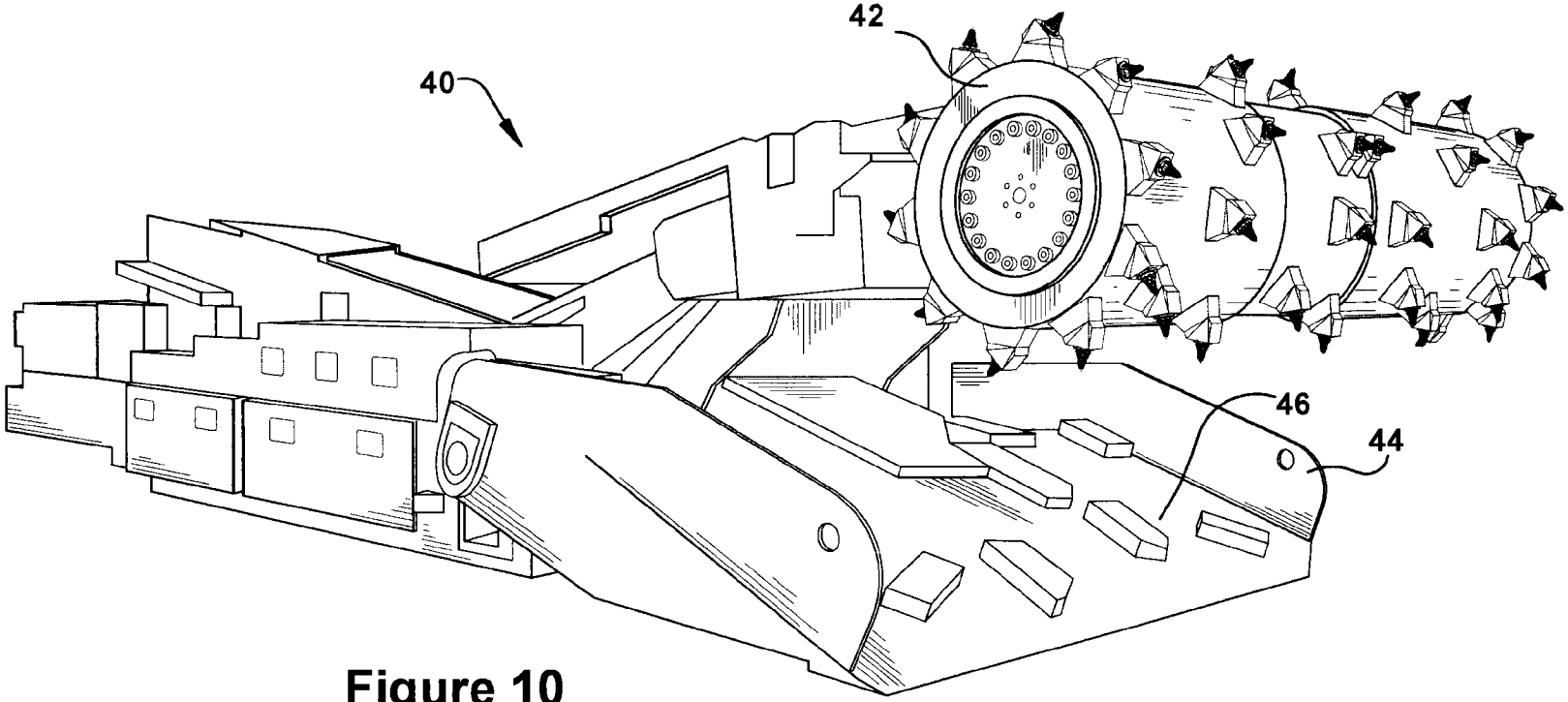
FIG. 10 is a perspective view of a mining machine equipped with a rotating drum.

FIG. 10 illustrates an exemplary embodiment of a mining machine 40 that includes a rotating drum 42 and a tray 44 positioned below the rotating drum 42 to collect material dislodge from a mine wall during the mining process. The tray 44 is equipped with a conveyor system 46 to move dislodge material back towards the opening of the mine. Drums 42 mounted on such mining machines 40 may be arranged so that material dislodged from the mine wall is channeled toward the center of the conveyor belt 46 to more efficiently remove the dislodged material from the mine. The arrangement of mining bit tools on the drum 42 may facilitate such channeling of dislodged material to the center of the drum 40 and onto the conveyor belt 46. As may best be seen in FIG. 11, a drum 42 may be arranged so that mining bit tools are positioned in two helical or spiral patterns that converge at the center of the drum 42. A first helical pattern 50 spirals from the left most edge 52 of the drum 42 (with respect to FIG. 11) to the center of the drum 42, and the second helical pattern 54 spirals from the right most edge 56 of the drum 42 (with respect to FIG. 11) to the center of the drum 42. It will be understood that the first 50 and second 54 helical patterns facilitate the channeling of dislodged material towards the center of the drum 42 so that such material generally falls onto the conveyor belt 46 positioned below the drum 42.

Figure 11:
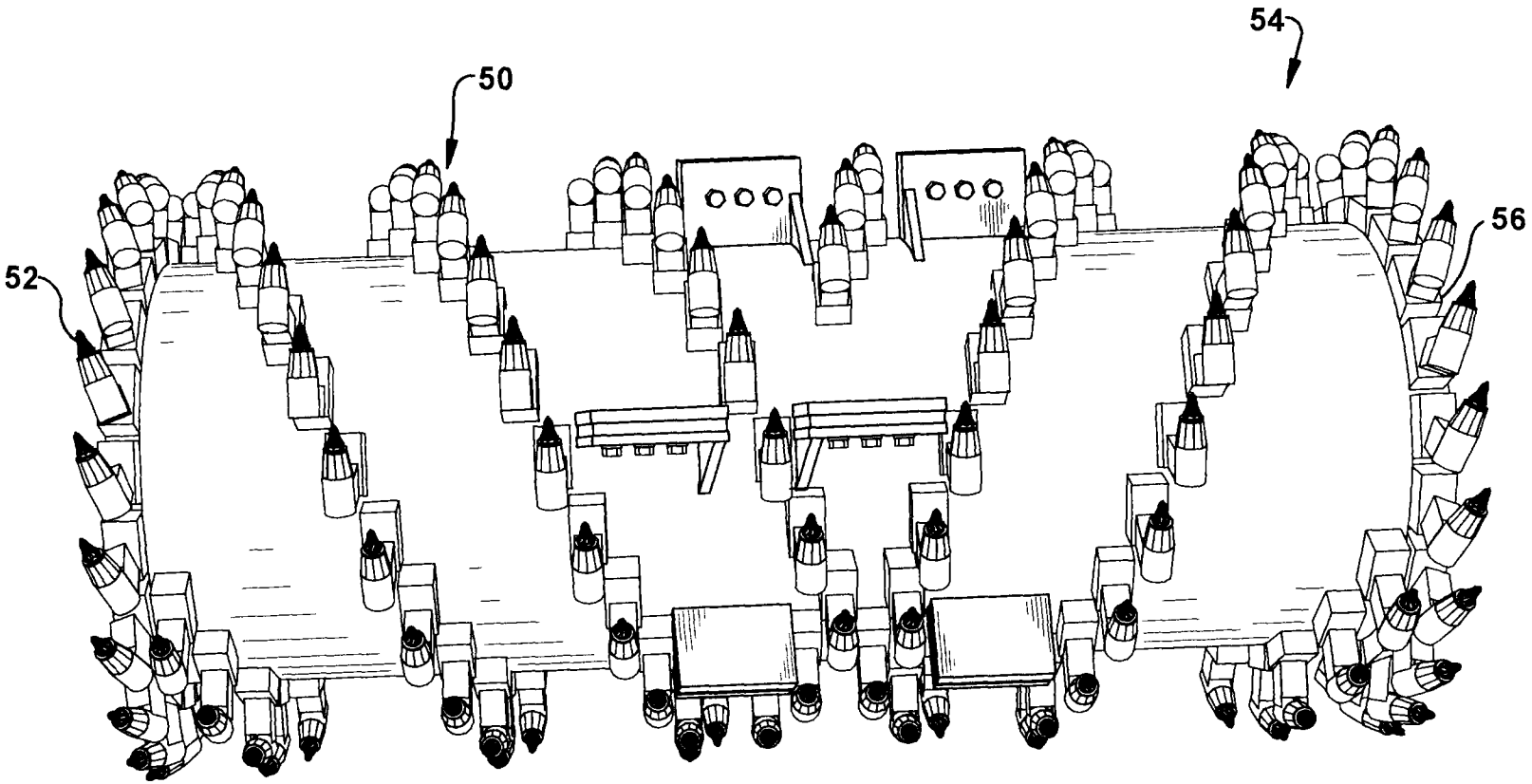
FIG. 11 is a perspective view of a rotating drum with a plurality of mining tools secured to the drum in helical patterns.
Figure 12:
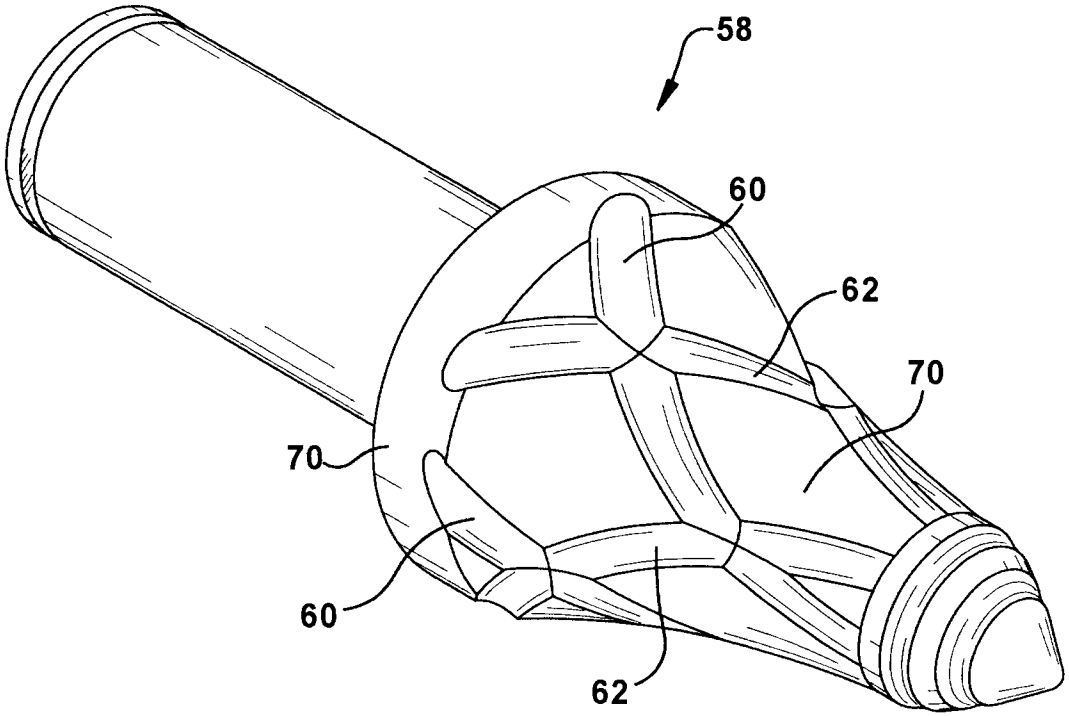
FIG. 12 is a perspective view of a mining bit tool.

A mining bit tool for use with the drum 42 illustrated in FIG. 11 may be arranged so that the mining tool may be secured to the drum 42 along either the first 50 or second 54 helical pattern. Such mining tools are exemplarily illustrated in FIGS. 12 and 13. The mining bit tool 58 shown in FIG. 12 is arranged generally as described above for other mining bit tools; however, the mining bit tool 58 includes two sets of flutes. The first set of flutes 60 spiral in helical pattern along a the tapered surface of the mining tool base in a first direction, and the second set of flutes 62 spiral in a helical pattern along the tapered surface of the mining tool base in a second direction. In such an arrangement, it is immaterial which portion of the mining tool 58 contacts the mine wall. The flutes 60, 62 provide contact surfaces for driving the mining tool 58 to rotate in either direction upon contact with the wall. Such an arrangement provides a mining bit tool 58 that may be positioned along the first helical pattern 50 of the drum 40 or along the second helical pattern 54 of the drum 40 of the drum 42. Regardless of whether the mining bit tool 58 is positioned along the first 50 or second 54 helical pattern of the drum 40, the mining bit tool 58 will rotate to continually provide different impact surfaces for dislodging material from the mine wall. Such an arrangement that provides for bi-directional rotation of the mining tool 58 allows for flexibility in assembling a rotating drum or maintaining a rotating drum. As the mining tool 58 is generally equally effective regardless of its positioning on the drum 42, assemblers or maintenance workers may install or replace mining tools 58 in a quick and efficient manner.

Figure 13:
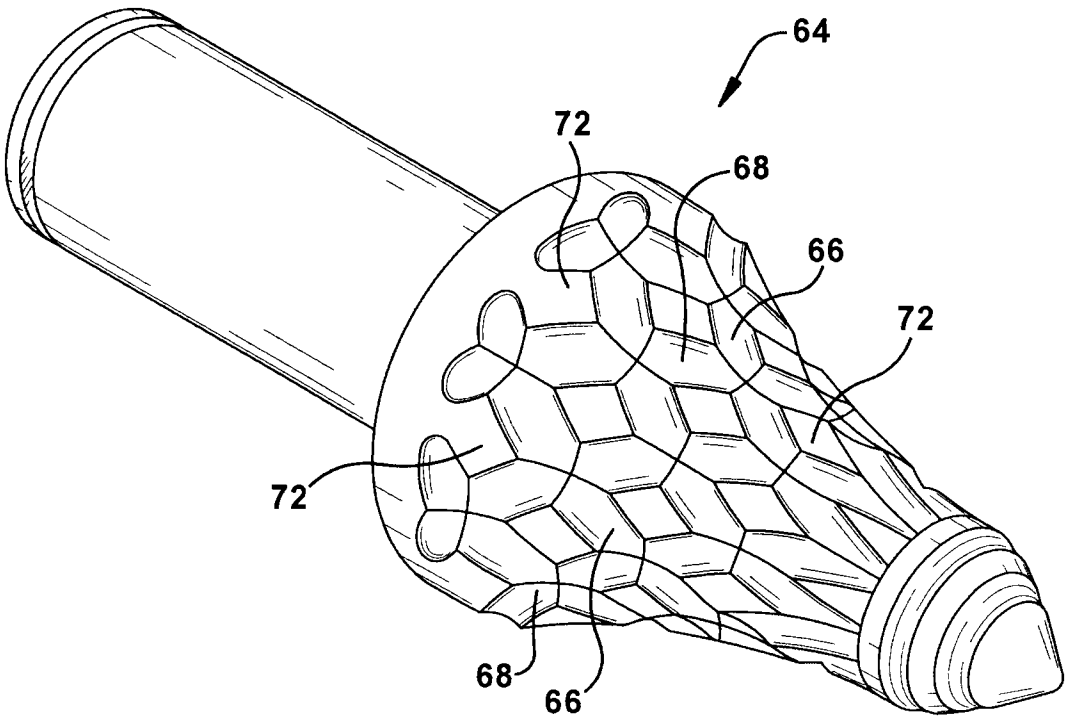
FIG. 13 is a perspective view of a mining bit tool.

FIG. 13 illustrates another embodiment of a mining bit tool 64 that includes two sets of flutes. Similar to the embodiment shown in FIG. 12, the first set of flutes 66 spiral along the tapered surface of the mining tool base in a first direction, and the second set of flutes 68 spiral along the tapered surface of the mining tool base in a second direction. In the arrangement shown in FIG. 13, the spacing between flutes is smaller than that shown in FIG. 12. The crisscross or interwoven nature of the flutes 60, 62 and 66, 68 form features 70, 72 that may facilitate the process of material removal from a mine wall.

The arrangement of the flutes 60, 62 and 66, 68 may be calculated to effectively work with the static and dynamic conditions of a mining machine operation. For example, different factors or physical parameters may be determined through calculation. For example, the width, depth, and angle of the flute, along with the spacing of the flutes may be calculated to achieve a desired level of performance.

It will be understood by those skilled in the art that the embodiments illustrated in FIGS. 12 and 13 are exemplary only that that many different arrangements of flutes or cutting features may be arranged to facilitate rotation of the mining tool in either direction.

Figure 14:
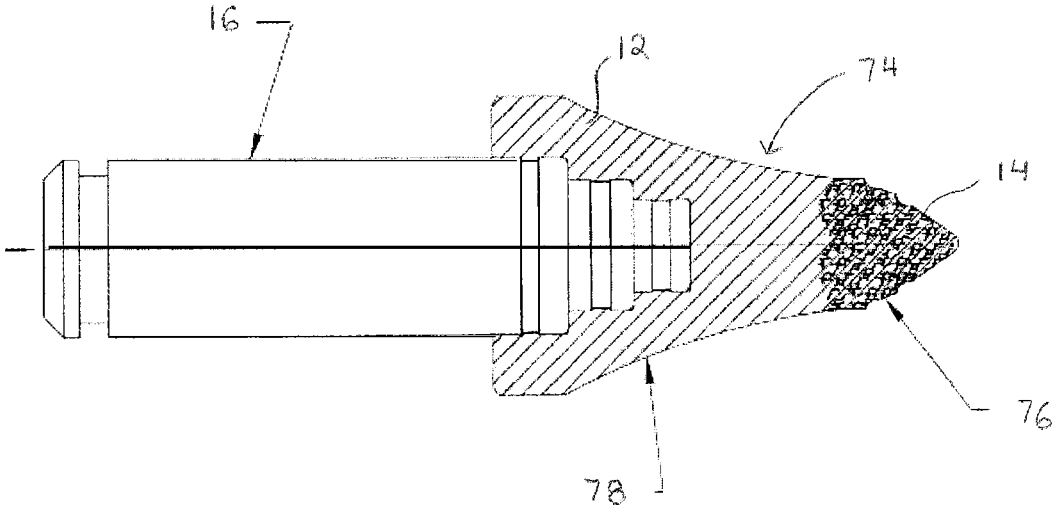
FIG. 14 is a perspective view of a mining bit tool having a unitary head.

In an embodiment, as illustrated in FIG. 14, the mining tool 10 may comprise a base 12 and tip 14 that are integrally formed and constructed as a single unitary piece. Unlike designs where the tip is brazed or otherwise connected to the base, the base 12 and tip 14 may be formed of powder metal that is sintered to produce a unitary tool head 74 comprising the base 12 and tip 14 as a single piece, as shown in FIG. 14. The head 74 may be connected to a stem 16, as described above. The head 74 may be comprised of materials such as carbon steel and tungsten carbide. The tungsten carbide particles 76 may be populated in and near the tip 14 of the head 74 and molecularly fused with the molecules 78 of the base 12, such as through the sintering process. The stem 16 may be formed of a high carbon steel.

In an embodiment, the tool head 74 may be microwave sintered to integrally form the tip 14 with the base 12. Specifically, the tungsten carbide particles 76 of the tip 14 and powder metal particles 78 of the base 12 may be microwave sintered to unify the molecules into a solid unitary head 74. The head 74 may comprise primarily tungsten carbide particles 76 at and near the tip 14 and other metal molecules, such as carbon steel molecules 78, throughout the base 12. It will be appreciated that while the tip 14 may be comprised of primarily tungsten molecules 76, it may also include some other metal molecules, such as carbon steel molecules.

In tests, numerical calculation of neck reduction during the microwave sintering process revealed anomalous values for diffusion coefficients of $7.16\times10^{-13}$ and $3.14\times10^{-8}$ $m^2 s^{-1}$ for 950 deg C. and 1200 deg C. respectively. The value of activation energy of neck growth process was calculated as 69.18 K joules $mol^{-1}$.

The invention has been described above and, obviously, modifications and alterations will occur to others upon the reading and understanding of this specification. The claims as follows are intended to include all modifications and alterations insofar as they come within the scope of the claims or the equivalent thereof.

We claim:

1. A mining tool comprising:

a tool head formed as a unitary piece comprising:

a base comprised of a first powder metal material and having a tapered surface;

at least one flute positioned along the tapered surface;

a tool tip comprised of a second powder metal material; and wherein the powder metal material of the base is molecularly integrated with the powder metal material of the tip and sintered to form the unitary tool head.

2. The mining tool of claim 1, wherein the tool tip is comprised of tungsten carbide.

3. The mining tool of claim 1 wherein the tool head is formed through a microwave sintering process.

4. The mining tool of claim 1, wherein the base is comprised of carbon steel.

5. The mining tool of claim 1, wherein at least one flute positioned along the surface is positioned at an angle relative to a longitudinal axis passing through a center of the mining and demolition bit tool.

6. The mining tool of claim 1 further comprising an annular groove in the tip.

7. The mining tool of claim 1 further comprising a stem extending from the base.

* * * * *